US009359722B2

(12) United States Patent
Boeck et al.

(10) Patent No.: US 9,359,722 B2
(45) Date of Patent: Jun. 7, 2016

(54) WOVEN WIRE WITH FLAT WARP THREADS

(71) Applicant: VOITH PATENT GMBH, Heidenheim (DE)

(72) Inventors: Johann Boeck, Fornach (AT); Johan Mattijssen, DW Huissen (NL); Matthias Hoehsl, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 14/195,097

(22) Filed: Mar. 3, 2014

(65) Prior Publication Data

US 2014/0251491 A1 Sep. 11, 2014

(30) Foreign Application Priority Data

Mar. 1, 2013 (DE) ..... 10 2013 203 529

(51) Int. Cl.

| | |
|---|---|
| ***D03D 15/00*** | (2006.01) |
| ***D03D 3/04*** | (2006.01) |
| ***D21F 7/08*** | (2006.01) |
| ***D21F 1/10*** | (2006.01) |
| ***D03D 11/00*** | (2006.01) |
| ***D21F 1/00*** | (2006.01) |
| *D03D 25/00* | (2006.01) |

(52) U.S. Cl.

CPC ..... *D21F 1/105* (2013.01); *D03D 11/00* (2013.01); *D03D 15/0083* (2013.01); *D21F 1/0045* (2013.01)

(58) Field of Classification Search

CPC ... D21F 1/0027; D21F 1/0045; D21F 1/0036; D21F 7/083; D21F 1/105; D21F 7/08; Y10S 162/903; Y10S 162/902; D03D 11/00; D03D 15/00; D03D 15/0083; D03D 13/004; D03D 15/0088; D03D 15/0094

See application file for complete search history.

(56) References Cited

U.S. PATENT DOCUMENTS

| | | | | |
|---|---|---|---|---|
| 4,705,601 | A | 11/1987 | Chiu | |
| 6,179,013 | B1 | 1/2001 | Gulya | |
| 7,415,993 | B2 * | 8/2008 | Hay et al. | 139/383 A |
| 7,513,276 | B2 * | 4/2009 | Westerkamp | 139/383 A |
| 7,571,746 | B2 * | 8/2009 | Hay et al. | 139/383 A |
| 7,585,395 | B2 * | 9/2009 | Quigley et al. | 162/358.4 |

(Continued)

FOREIGN PATENT DOCUMENTS

| | | | |
|---|---|---|---|
| DE | 3750430 | T2 | 12/1994 |
| GB | 2157328 | A | 10/1985 |
| WO | 8805841 | A1 | 8/1988 |

*Primary Examiner* — Bobby Muromoto, Jr.

(74) *Attorney, Agent, or Firm* — Laurence A. Greenberg; Werner H. Stemer; Ralph E. Locher

(57) ABSTRACT

A woven wire for use in a paper, cardboard, or tissue manufacturing machine, has a first fabric layer providing a web-contact side and a second fabric layer providing a machine-contact side. The layers have machine-direction threads, cross-direction threads, and binder threads. A first fabric layer has a weaving pattern of interwoven first MD threads, first CD threads and binder threads. The second fabric layer has a weaving pattern of interwoven second MD threads and second CD threads. The first and second fabric layers are interconnected by binder threads. The binder threads are interwoven with MD threads and/or CD threads of the first and of the second fabric layers. The first MD threads, the first CD threads and the binder threads have a circular cross-sectional face. At least some or all second MD threads have a cross-sectional face with a flattened shape different from a circular shape.

18 Claims, 3 Drawing Sheets

(56) References Cited

U.S. PATENT DOCUMENTS

| | | | | |
|---|---|---|---|---|
| 7,611,607 | B2 * | 11/2009 | Mullally et al. | 162/348 |
| 7,717,141 | B1 * | 5/2010 | Quigley | 139/383 A |
| 7,721,769 | B2 * | 5/2010 | Fernandes | 139/383 A |
| 7,740,029 | B2 * | 6/2010 | Hodson et al. | 139/383 A |
| 7,896,034 | B2 * | 3/2011 | Harwood et al. | 139/383 A |
| 7,993,493 | B2 * | 8/2011 | Quigley | 162/348 |
| 8,038,847 | B2 * | 10/2011 | Quigley | 162/348 |
| 8,114,254 | B2 * | 2/2012 | Quigley | 162/348 |
| 8,141,595 | B2 * | 3/2012 | Quigley | 139/383 A |
| 8,273,218 | B2 * | 9/2012 | Kockritz | 162/358.2 |
| 8,328,990 | B2 * | 12/2012 | Quigley | 162/348 |
| 8,480,857 | B2 * | 7/2013 | Quigley | 162/358.2 |
| 8,500,958 | B2 * | 8/2013 | Jeffrey et al. | 162/306 |
| 8,622,095 | B2 * | 1/2014 | Quigley | 139/383 A |
| 8,789,289 | B2 * | 7/2014 | Herman et al. | 34/453 |
| 8,808,506 | B2 * | 8/2014 | Quigley | 162/348 |
| 2004/0118473 | A1 * | 6/2004 | Hay et al. | 139/383 R |
| 2006/0016508 | A1 * | 1/2006 | Westerkamp et al. | 139/383 R |
| 2007/0028996 | A1 * | 2/2007 | Quigley | 139/383 R |
| 2007/0197334 | A1 * | 8/2007 | Schmitt | 474/266 |
| 2007/0209770 | A1 * | 9/2007 | Barrett et al. | 162/358.2 |
| 2007/0261753 | A1 * | 11/2007 | Hodson | 139/383 A |
| 2008/0105323 | A1 * | 5/2008 | Hay et al. | 139/383 A |
| 2008/0149213 | A1 * | 6/2008 | Quigley | 139/408 |
| 2008/0149214 | A1 * | 6/2008 | Quigley | 139/410 |
| 2009/0035537 | A1 * | 2/2009 | Hack-Ueberall et al. | 428/196 |
| 2009/0065166 | A1 * | 3/2009 | Quigley | 162/348 |
| 2009/0065167 | A1 * | 3/2009 | Quigley | 162/348 |
| 2009/0068909 | A1 * | 3/2009 | Quigley | 442/205 |
| 2009/0075543 | A1 * | 3/2009 | Zhang et al. | 442/199 |
| 2009/0205739 | A1 * | 8/2009 | Quigley | 139/35 |
| 2009/0205740 | A1 * | 8/2009 | Quigley | 139/408 |
| 2009/0308558 | A1 * | 12/2009 | Quigley | 162/267 |
| 2010/0258259 | A1 * | 10/2010 | Boeck | 162/289 |
| 2012/0024486 | A1 * | 2/2012 | Quigley | 162/109 |
| 2012/0291975 | A1 * | 11/2012 | Hoehsl et al. | 162/358.2 |
| 2014/0027080 | A1 * | 1/2014 | Hohsl et al. | 162/202 |
| 2014/0251491 | A1 * | 9/2014 | Boeck et al. | 139/410 |

* cited by examiner

WOVEN WIRE WITH FLAT WARP THREADS

CROSS-REFERENCE TO RELATED APPLICATION

This application claims the priority, under 35 U.S.C. §119, of German application DE 10 2013 203.529.2, filed Mar. 1, 2013; the prior application is herewith incorporated by reference in its entirety.

BACKGROUND OF THE INVENTION

Field of the Invention

The invention relates to a woven wire, in particular a forming wire, for use in a machine manufacturing and/or processing a fibrous web, in particular a paper, cardboard, or tissue machine. A first fabric layer provides a web-contact side and a second fabric layer provides a machine-contact side. The layers are arranged above one another and have first MD (machine-direction) threads, first CD (cross-direction) threads, second MD threads, second CD threads and binder threads. The first fabric layer has a weaving pattern which is formed by interweaving the first MD threads, the first CD threads and the binder threads, the second fabric layer has a weaving pattern which is formed by interweaving the second MD threads with the second CD threads. The first and the second fabric layers are interconnected by binder threads, in that the binder threads are interwoven with MD threads and/or CD threads of the first and of the second fabric layers. The first MD threads, the first CD threads and the binder threads have a circular cross-sectional face.

A multiplicity of often contradictory requirements are placed on forming wires for use in paper, cardboard, or tissue machines. Thus, for the manufacture of high-quality paper and cardboard, such machines must provide a web-contact side, which can be brought into contact with the fibrous web, that is as smooth as possible and have a de-watering behavior which is distributed as uniformly as possible across the web-contact side. In order to ensure effective and rapid de-watering, in particular in the case of fast-running machines, such wires must also have an inner volume which is as small as possible, in order to keep what is referred to as "water entrainment" as low as possible. On the other hand, de-watering must not happen too abruptly, since otherwise only insufficient retention of fibrous and filling material is provided. In times of increasing energy and raw-material costs, such wires must not have a high load pick-up in terms of operating power, for example caused by low dimensionally stability and/or slippage of the wires on the drive elements. Low dimensional stability may be caused, for example, by expansion of the wires in the machine direction (MD direction) and/or insufficient rigidity of such wires in the cross machine direction (CD direction), which can lead to fluttering of said wires. Furthermore, such wires must have a long service life during operation which, inter alia, requires a high wear volume on the machine-contact side of such wires.

In order to meet at least some of the abovementioned requirements, what is referred to as sheet-support binder wires (SSB wires), which are constructed using two fabric layers which are independent of one another and which, in turn, are interconnected by binder threads, have been proposed in the past.

A refinement of such SSB wires is disclosed, for example, in U.S. Pat. No. 6,179,013, where, for reducing the inner volume of such wires, it is proposed to use cross machine threads (CD threads) having a flattened cross section in the lower fabric layer which provides the machine-contact side. The disadvantage of the wires proposed in this document is their insufficient rigidity in the cross machine direction, which is caused by the flattened cross machine threads (CD threads) which, in comparison to CD threads having a circular cross-sectional face, provide a lower flexural rigidity. It has also been demonstrated that wires having CD threads with a cross-sectional face having a flattened shape are difficult to manufacture, since CD threads—which typically are weft threads—can be twisted during weft insertion, which may lead to a weaving structure which cannot be reproduced.

GB2157328 further discloses what is referred to as a two-layered wire, which has two layers of CD threads arranged above one another and interwoven with MD threads having a flattened cross-sectional shape, by alternately interweaving the MD threads with CD threads of both layers. Such wires as disclosed in GB'328 have the disadvantage that the MD threads, which absorb a substantial part of the driving power, alternate between the two CD-thread layers and, therefore, the MD threads contract the two CD-thread layers in the case of a tensile load in the MD direction, resulting in an elongation of such wires in the MD direction, on account of which a lot of driving power is "wiped out" for said elongation. Furthermore, wires having flattened threads on the web-contact side demonstrate a non-satisfactory marking behavior, i.e. conditionally increased hydraulic and topographic markings in comparison to wires having a circular cross-sectional face on the web-contact side.

BRIEF SUMMARY OF THE INVENTION

Proceeding from the above-described disadvantages of wires known from the prior art, it is the object of the present invention to propose wires, for use in paper, cardboard, or tissue machines, which, with a low tendency to marking, provide high dimensional stability coupled with a low inner volume and which, moreover, are manufacturable in a simple and cost-effective manner.

The object is achieved by a woven wire as claimed.

On account of the first fabric layer, which provides the web-contact side, being formed by threads having a round cross section, a first fabric layer having low hydraulic and topographic marking is provided.

On account of the second fabric layer comprising MD threads having a flattened cross section, a wire which has a low inner volume paired with high dimensional stability is provided. The substantial tensile load during operation of a wire in a paper, cardboard, or tissue machine is absorbed by the MD threads of the second fabric layer, i.e. the fabric layer providing the machine-contact side, since the MD threads of the first fabric layer, i.e. the fabric layer providing the web-contact side, have to be very thin in order to avoid markings. In order to be able to ensure a pre-defined dimensional stability in the MD direction during operation of the wire in the machine, the MD threads of the second fabric layer must have a specific cross-sectional face. Since, according to the invention, the MD threads of the second fabric layer have a flattened cross-sectional face, dimensional stability can, according to the invention, be maintained by reducing the height of the threads while simultaneously widening said threads in comparison to fabrics having round MD threads with the same cross-sectional face in the second fabric layer. On account thereof, the thickness of the second fabric layer and, thus, of the wire is reduced, on account of which what is referred to as water entrainment can be effectively eliminated. On account of the flattened threads extending in the MD direction, transverse stability of the wire, i.e. the stability of the wire in the CD direction, is not adversely influenced thereby; that is to say that a second fabric layer, and thus a wire, which—in comparison to a wire having round MD threads with the same cross-sectional face—has a reduced thickness with maintained stability in the MD and CD directions is provided.

If the wire according to the invention is a flat-woven wire, i.e. a wire in which the MD threads are warp threads and the CD threads are weft threads, the solution according to the invention furthermore provides a wire which has a small thickness and is manufacturable in a simple and reproducible manner.

MD threads in the sense of the present invention are such threads which, when the wire is used as intended in the machine manufacturing a fibrous web, extend in their MD direction. CD threads in the sense of the present inventions are such threads which, when the wire is used as intended in the machine manufacturing a fibrous web, extend in their CD direction.

Advantageous configurations and refinements of the invention are stated in the dependent claim It is conceivable, for example, that the shape of the cross-sectional face of the second MD threads is rectangular, square, bone-shaped or elliptic, wherein the shape of the cross-sectional face of the second MD threads has, in particular, an aspect ratio of height (H) to width (W) of less than one, in particular in the region of 1:1.15 to 1:1.75. It has been demonstrated that an effective reduction in thickness of the wire according to the invention, paired with a "twist-safe" handling of the MD threads during manufacturing of the wire, can be achieved at the above-stated aspect ratio.

A rectangular or square shape of the cross-sectional face may also comprise that the edges of the rectangle or of the square are rounded, i.e., apart from the two sides which are in each case parallel to one another and lie opposite one another, these shapes may also comprise curves which interconnect the sides.

An aspect ratio of height (H) to width (W) of less than one is to be understood to mean, in particular, that the height (H) of the MD threads, i.e. their extent in the thickness direction of the wire, is less than their width (W), i.e. their extent in the cross machine direction of the wire.

The ratio of the number of first MD threads to second MD threads is preferably greater than 1, wherein the number ratio is, in particular, not an integer. In this context, ratios of the number of first MD threads to second MD threads of 3:2, 4:3 or 5:3 are conceivable in particular. On account of the provision of a wire having more MD threads in the first fabric layer than in the second fabric layer, a first fabric layer having a large fiber-support face and, simultaneously, an open second fabric layer, i.e. a machine-contact side fabric layer, are provided. The first fabric layer, while maintaining a warp-fill factor, may be implemented here with thin MD threads and CD threads, on account of which the thickness of the wire may be reduced even further. On account of the provision of second MD threads, having a flattened cross-sectional face, in the second fabric layer, the openness of the second fabric layer, and thus the de-watering behavior, can be controlled within certain limits, for example by setting the abovementioned aspect ratio. This is, in particular, very meaningful in the case of wires for use in "critical machines", since individual solutions to problems can thus be provided for the respective machine.

It is provided, in particular, that the ratio of the number of first CD threads to second CD threads is greater than 1, in particular is not an integer. Conceivable ratios of the number of first CD threads to second CD threads are, for example, 2:1, 3:2 or 5:3. On account of this measure, in particular the abovementioned measure for obtaining a first fabric layer having high fiber support on the web-contact side with, simultaneously, an open second fabric layer on the machine-contact side can be further refined, on account of which such wires are, in particular, suitable for use in fast-running machines which are used for manufacturing printed paper or cardboard.

Accordingly, in particular the ratio of the number of first MD threads to second MD threads and the ratio of the number of first CD threads to second CD threads is in each case greater than 1. Ratios such as 3:2 (MD1:MD2) combined with 3:2 (CD1:CD2), or 3:2 (MD1:MD2) combined with 2:1 (CD1:CD2), or 3:2 (MD1:MD2) combined with 5:3 (CD1:CD2), are, in particular, conceivable (note: MD1 means first MD threads; MD2 means second MD threads; CD1 means first CD threads; CD2 means second CD threads).

A further possible configuration of the invention provides that the machine-contact side is substantially provided by the second MD threads. In this case, the second CD threads, therefore run for the most part in the interior of the wire according to the invention. In other words, in this configuration, the second MD threads, along the major part of their weaving path, run on that side of the second fabric layer that faces toward the machine-contact side and hereby provide a major part of the machine-contact side of the second fabric layer, whereas the second CD threads, along the major part of their weaving path, run on that side of the second fabric layer which faces toward the web-contact side, i.e. in the interior of the wire. Accordingly, in this configuration, the second MD threads provide a major part of the wear volume of the wire. This is what is referred to as a "warp runner". On account of the cross-sectional face of the second MD threads having a flattened shape, a higher wear volume than in the case of round MD threads can thus be provided.

In this context, it is conceivable that, in particular, the second MD threads, which provide a major part of the machine-contact side, form in each case thread floats across at least four second CD threads which are immediately adjacent to one another.

In a refinement of the invention, which is an alternative to the aforementioned configuration, it is provided, in particular, that the machine-contact side is substantially provided by the second CD threads.

In this case, the second MD threads, for the major part of their weaving path, accordingly run in the interior of the wire. In other words, in this configuration the second CD threads, along the major part of their weaving path, run on that side of the second fabric layer that faces toward the machine-contact side and hereby provide a major part of the machine-contact side of the second fabric layer, whereas the second MD threads, along the major part of their weaving path, run along that side of the second fabric layer that faces toward the web-contact side, i.e. in the interior of the wire. Accordingly, in this configuration, the second CD threads provide the wear volume of the wire. This is what is referred to as a "weft runner". On account of the cross-sectional face of the second MD threads which run in the interior of the wire having a flattened shape, not only is the thickness of the second fabric layer per se reduced, but since the flat MD threads run within the wire, the distance between the two fabric layers is also reduced, on account of which the relative mobility of the two fabric layers in relation to one another and, therefore, internal wear of the wire are effectively eliminated.

In order to further reduce the thickness of the wire, it is, in particular, provided that the second CD threads, which provide the major part of the machine-contact side, form in each case thread floats across at least four second MD threads which are immediately adjacent to one another.

It is also conceivable for the second CD threads to have a circular cross-sectional shape. In particular in the case of a given cross-sectional face, higher flexural rigidity of the wire in the CD direction in comparison to wires having flattened second CD threads is achieved on account thereof.

For wires which, for example on account of their weaving structure, already have sufficient flexural rigidity in the CD direction, it may, however, also be meaningful to select instead of second CD threads having a circular cross-sectional face such CD threads which have a flattened shape that deviates from the circular shape. This measure may, in particular, contribute toward a further reduction in the thickness of the wire.

According to a further preferred configuration of the invention, it is provided that the ratio of the diameter (D) of the first MD threads to the height (H) of the second MD threads is in the region of 0.2 to 0.8, in particular is 0.4 to 0.6. In the case of wires having the stated ratio, the solution according to the invention has a particularly positive effect, since here the first or web-contact side fabric layer is particularly fine in comparison to the second or machine-contact side fabric layer, and the effect of the reduction in thickness paired with high dimensional stability, in particular in the MD direction, and a fine first fabric layer are, therefore, particularly evident.

In this context it is preferably provided that the first CD threads and/or the binder threads have substantially the same diameter as the first MD threads. Substantially is to be understood here to mean a deviation of at maximum 20%, in particular at maximum 10%.

If the wire according to the invention is what is referred to as a weft runner, it is particularly meaningful for the ratio of the diameter (D) of the second CD—threads to the height (H) of the second MD threads to be greater than 1, in particular in the region of 1.5 to 3.0, preferably in the region of 1.6 to 2.5, since, on account thereof and without increasing the wire thickness, the wear volume can be kept large and the inner volume of the wire can be kept small.

If the wire according to the invention is what is referred to as a warp runner, it is particularly meaningful for the ratio of the diameter (D) of the second CD threads to the height (H) of the second MD threads to be smaller than 1, in particular greater than 1 and smaller than 1.5, since, on account thereof and without increasing the wire thickness, the wear volume can be kept large and the inner volume of the wire can be kept small.

The binder threads are preferably arranged in pairs and are interwoven with threads of the first and second fabric layers in such a manner that, when a first binder thread of the pair binds with one or more threads of the first fabric layer, the second binder thread of the pair interweaves with one or more threads of the second fabric layer, and vice versa, wherein the weaving pattern formed by interweaving of the first MD threads with the first CD threads is continued, in particular, on account of the binder threads being interwoven with the first MD threads and/or first CD threads.

The binder threads preferably extend in the CD thread direction. In this case, the weaving pattern of the first fabric layer is formed by interweaving the binder threads and first CD threads with the first MD threads. In this context, it is furthermore preferably provided that, on account of interweaving the binder threads with the first MD threads, the weaving pattern formed by interweaving the first MD threads with the first CD threads is continued.

It may be provided as an alternative to this that the binder threads extend in the MD thread direction. In this case, the weaving pattern of the first fabric layer is formed by interweaving the first CD threads with the first MD threads and the binder threads. In this context, it is furthermore preferably provided that, on account of interweaving the binder threads with the CD threads, the weaving pattern formed by interweaving the first MD threads with the first CD threads is continued.

In order to provide a first fabric layer having a web-contact face with an extremely low potential for marking, a preferred configuration of the invention provides that the weaving pattern of the first fabric layer is a plain weave.

In order to provide a good wear volume, paired with a low potential for marking, it proves advantageous for the weaving pattern of the second fabric layer to be a satin weave, such as, for example, a 5-shaft, 6-shaft or 7-shaft satin weave.

According to another configuration of the invention, the wire has a thickness which, in particular, is in the region of 0.65 mm to 1.2 mm, particularly preferably in the region of 0.75 mm to 1.0 mm.

The woven wire according to the invention has, in particular, a permeability in the region of 310 cfm to 470 cfm, measured according to PCA: "Approved Standard Measuring Methods", Section E 4, Edition June 2002.

The first fabric layer preferably provides in the region of at least 1600 to at maximum 2200 support points per $cm^2$.

BRIEF DESCRIPTION OF THE SEVERAL VIEWS OF THE DRAWING

The invention is explained in more detail in the following by means of a preferred exemplary embodiment with reference to the figures. In the drawings.

DESCRIPTION OF THE INVENTION

Figure 1:
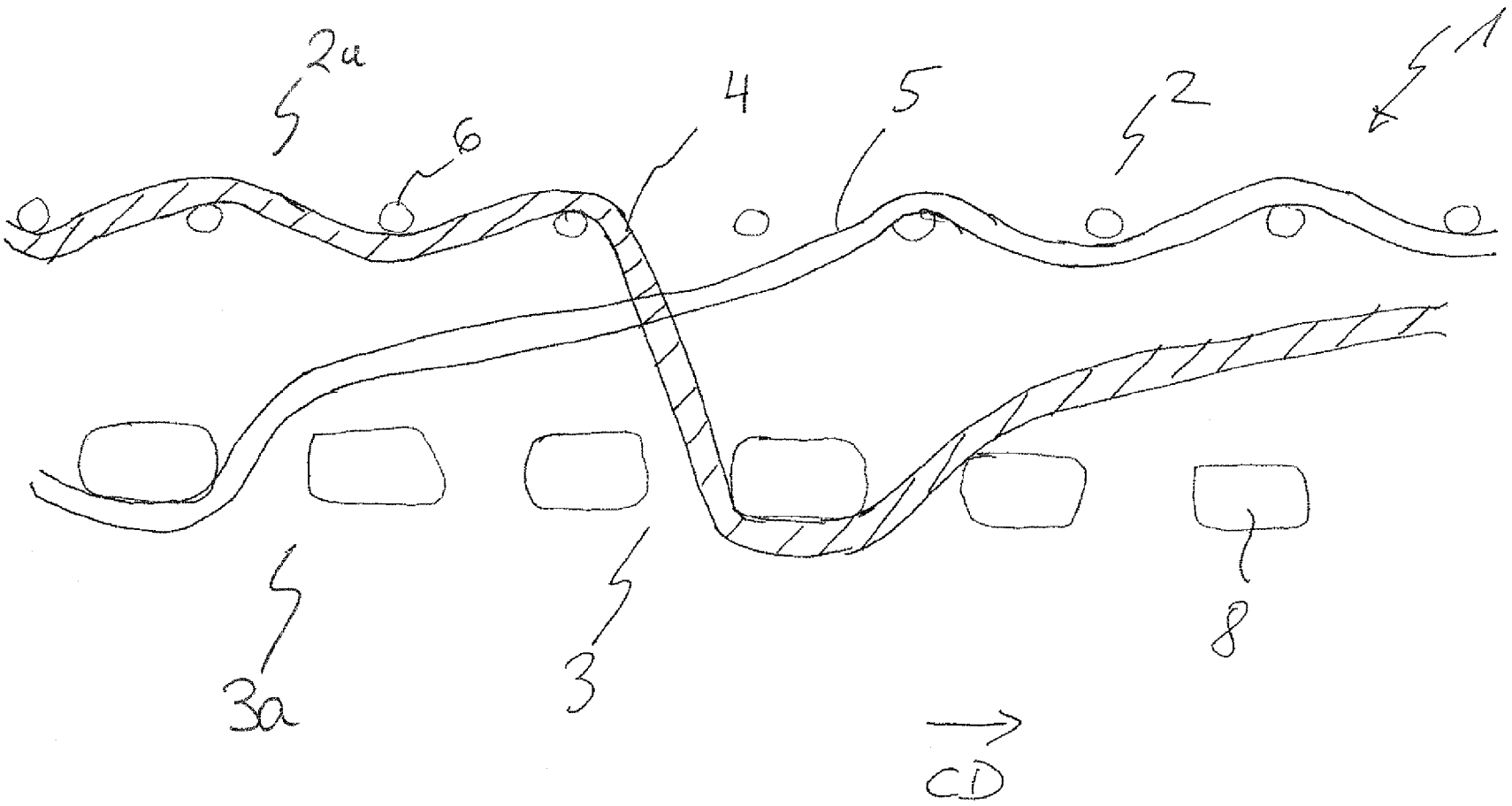
FIG. 1 shows a forming wire according to the invention in the sectional direction along binder threads running in the CD direction.
Figure 2:
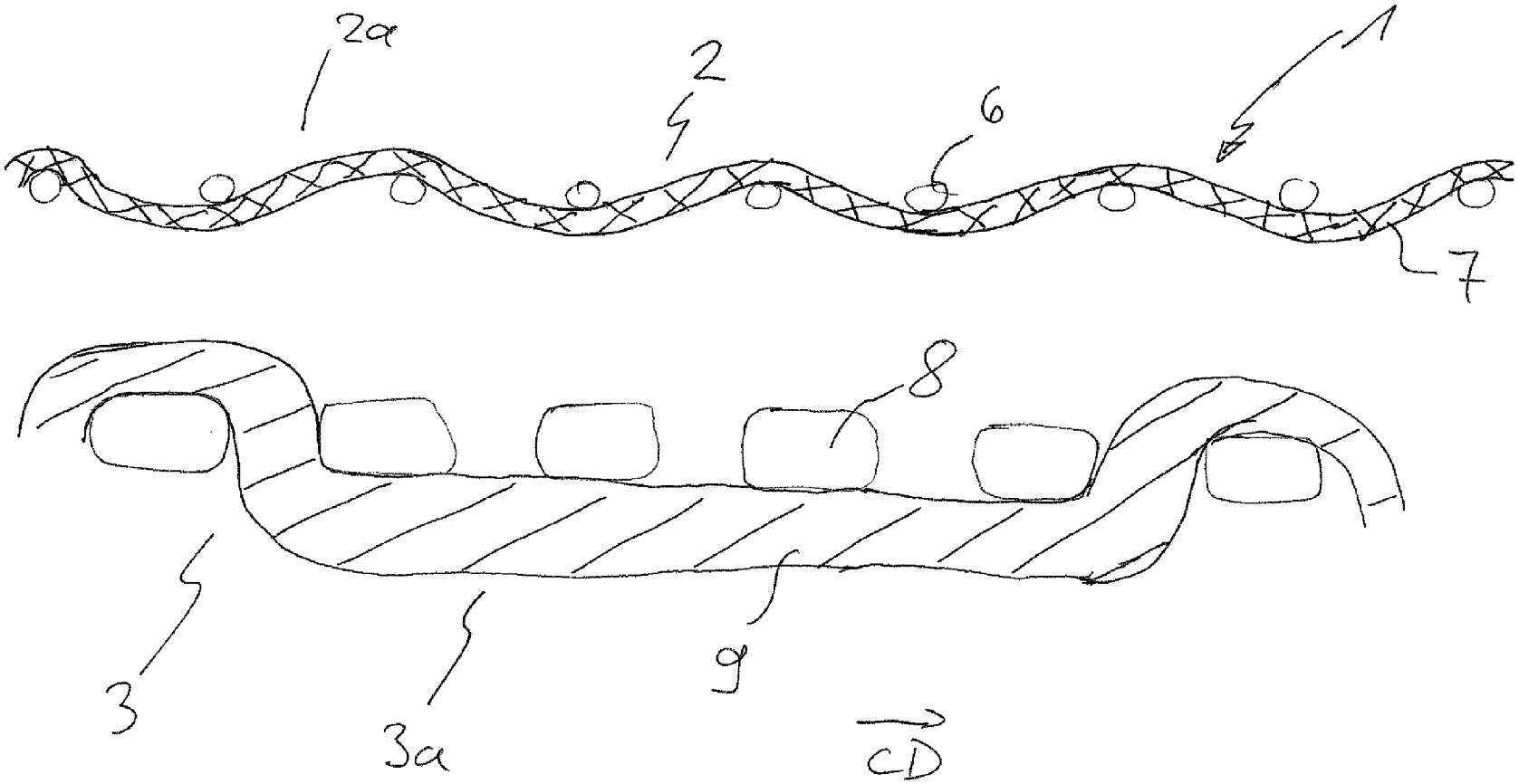
FIG. 2 shows the forming wire according to the invention in the sectional direction along CD threads.

FIGS. 1 and 2 show a forming wire 1 according to the invention, which comprises a first fabric layer 2 providing a web-contact side 2*a* and a second fabric layer 3 providing a machine-contact side 3*a*, which layers are interconnected by binder threads 4, 5 which are arranged in pairs and which, in the present case, extend in the CD direction.

In the present case, the weaving pattern of the first fabric layer 2 is a plain weave which is formed by interweaving first MD threads 6 with the binder threads 4, 5 and by interweaving the first MD threads 6 with the first CD threads 7.

According to the invention, the first MD threads 6, the first CD threads 7 and the binder threads 4, 5 here have a circular cross-sectional face having substantially the same size.

The weaving pattern of the second fabric layer 3 is a 5-shaft satin weave which is formed by interweaving second MD threads 8 with second CD threads 9. Since the binder threads 4, 5 have a substantially smaller cross-sectional face than the second MD threads 8 and than the second CD threads 9, said binder threads 4, 5 do not contribute toward the weaving pattern of the second fabric layer 3.

The second MD threads 8 here have a cross-sectional face having a flattened shape, wherein the shape of the cross-sectional face of the second MD threads 8, in the present case, has an aspect ratio of height (H) to width (W) of 1:1.65. Specifically, the shape of the cross-sectional face of the second MD threads in the present case is rectangular, wherein the edges are rounded. Furthermore, the second CD threads 9 have a cross-sectional face of circular shape.

As can be seen from the illustration of FIG. 2, in this configuration the second CD threads 9, along the major part of their weaving path, run on that side of the second fabric layer 3 that faces toward the machine-contact side 3*a* and hereby provide a major part of the machine-contact side 3*a* of the second fabric layer 3, whereas the second MD threads 8, along the major part of their weaving path, run along that side of the second fabric layer 3 that faces toward the web-contact side 2*a*, i.e. in the interior of the wire. As can be seen in FIG. 2, the second CD threads 9, on that side of the second fabric layer 3 that faces toward the machine-contact side 3*a*, provide in each case thread floats across at least four second MD threads 8 which are immediately adjacent to one another.

Accordingly, in this configuration, the second CD threads 9 provide the wear volume of the wire. This is what is referred to as a "weft runner".

As can also be seen in the illustrations of FIGS. 1 and 2, the ratio of the number of first MD threads 6 to second MD threads 8, in the present case, is greater than 1 and is not an integer, namely 1.5. The present wire may furthermore have a ratio of the number of first CD threads 7 to second CD threads 9 of 3:2 or 2:1.

Furthermore, the ratio of the diameter (D) of the first MD threads 6 to the height (H) of the second MD threads 8 is in the region of 0.45 to 0.5.

Figure 3:
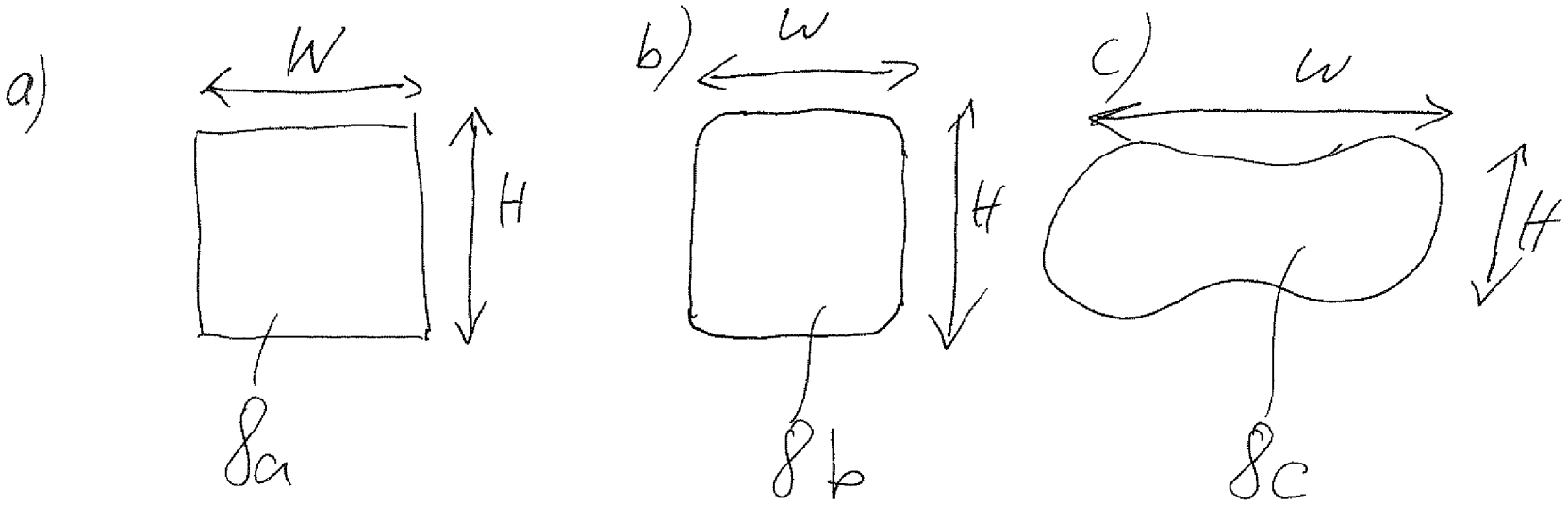
FIG. 3 shows various possibilities of shapes of the cross-sectional face of the second MD threads.

FIG. 3 shows various possibilities of shapes of the cross-sectional face of the second MD threads 8.

FIG. 3*a* here shows a second MD thread 8*a*, the cross-sectional face of which has a rectangular shape without rounded edges, having an aspect ratio H-to-W of 1:1.2.

Furthermore, FIG. 3*b* shows a second MD thread 8*b*, the cross-sectional face of which has a rectangular shape with rounded edges, having an aspect ratio H-to-W of 1:1.2.

Furthermore, FIG. 3*c* shows a second MD thread 8*c*, the cross-sectional face of which has the shape of a dumbbell or a bone, wherein the aspect ratio H-to-W is 1:1.7.

The invention claimed is:

1. A woven wire for use in a machine manufacturing and/or processing a fibrous web, the woven wire comprising:

a first fabric layer providing a web-contact side and a second fabric layer providing a machine-contact side;

said first and second fabric layers being disposed above one another and having first machine direction threads, first cross-direction threads, second MD threads, second CD threads and binder threads;

said first fabric layer having a weaving pattern formed by interweaving said first MD threads, said first CD threads and said binder threads;

said second fabric layer having a weaving pattern formed by interweaving said second MD threads with said second CD threads;

said first and second fabric layers being interconnected by binder threads, with said binder threads interwoven with MD threads and/or CD threads of said first and second fabric layers;

said first MD threads, said first CD threads, and said binder threads having a circular cross section;

said second MD threads having a cross-section with a flattened shape deviating from said circular cross section; and said second MD threads running along a majority of a weaving path thereof on a side of said second fabric layer facing toward the machine to provide a majority of the machine-contact side, and said second CD threads running along a majority of a weaving path thereof in an interior of the wire.

2. The woven wire according to claim 1, wherein said second MD threads have a cross-section with a flattened shape different from a circular shape.

3. The woven wire according to claim 1, wherein the shape of the cross-sectional face of said second MD threads is a shape selected from the group consisting of rectangular, bone-shaped, and elliptic.

4. The woven wire according to claim 1, wherein the shape of the cross-sectional face of said second MD threads has an aspect ratio of a height to width between 1:1.15 and 1:1.75.

5. The woven wire according to claim 1, wherein a ratio of a number of first MD threads to second MD threads is greater than 1.

6. The woven wire according to claim 5, wherein the ratio of the number of first MD threads to second MD threads is not an integer.

7. The woven wire according to claim 1, wherein a ratio of a number of first CD threads to second CD threads is greater than 1.

8. The woven wire according to claim 1, wherein the ratio of the number of first CD threads to second CD threads is not an integer.

9. The woven wire according to claim 1, wherein the machine-contact side is substantially provided by the second CD threads.

10. The woven wire according to claim 9, wherein a ratio of a diameter of said second CD threads to a height of said second MD threads is greater than 1.

11. The woven wire according to claim 10, wherein the ratio of the diameter of said second CD threads to the height of said second MD threads lies within a range of 1.5 to 3.0.

12. The woven wire according to claim 10, wherein the ratio of the diameter of said second CD threads to the height of said second MD threads lies within a range of 1.6 to 2.5.

13. A woven wire for use in a machine manufacturing and/or processing a fibrous web, the woven wire comprising:

a first fabric layer providing a web-contact side and a second fabric layer providing a machine-contact side;

said first and second fabric layers being disposed above one another and having first machine direction threads, first cross-direction threads, second MD threads, second CD threads and binder threads;

said first fabric layer having a weaving pattern formed by interweaving said first MD threads, said first CD threads and said binder threads;

said second fabric layer having a weaving pattern formed by interweaving said second MD threads with said second CD threads;

said first and second fabric layers being interconnected by binder threads, with said binder threads interwoven with MD threads and/or CD threads of said first and second fabric layers;

said first MD threads, said first CD threads, and said binder threads having a circular cross section;

said second MD threads having a cross-section with a flattened shape deviating from said circular cross section;

the machine-contact side being substantially provided by said second CD threads; and said second MD threads extending substantially on a side of said second fabric layer facing toward said first fabric layer.

14. The woven wire according to claim 9, wherein said second CD threads on a side of said second fabric layer facing toward the machine-contact side provide in each case thread floats across at least four said second MD threads that lie immediately adjacent one another.

15. The woven wire according to claim 1, wherein said second CD threads have a circular cross-sectional shape.

16. The woven wire according to claim 1, wherein a ratio of a diameter of said first MD threads to a height of said second MD threads lies in a range from 0.3 to 0.8.

17. The woven wire according to claim 1, wherein said binder threads extend in the CD-thread direction.

18. The woven wire according to claim 1, wherein the woven wire fabric has a permeability in a range from 310 cfm ($ft^3$/min) to 470 cfm ($ft^3$/min).

* * * * *